US006681021B1

(12) United States Patent
Saltykov

(10) Patent No.: US 6,681,021 B1
(45) Date of Patent: Jan. 20, 2004

(54) DIRECTIONAL ITE HEARING AID USING DUAL-INPUT MICROPHONE

(75) Inventor: Oleg Saltykov, Fairlawn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 0 days.

(21) Appl. No.: 09/213,623

(22) Filed: Dec. 18, 1998

(51) Int. Cl.[7] ..... H04R 25/00
(52) U.S. Cl. ..... 381/328; 381/313
(58) Field of Search ..... 381/313, 356, 381/328, 330, 322

(56) References Cited

U.S. PATENT DOCUMENTS 3,876,843 A 4/1975 Moen ..... 179/107
4,142,072 A 2/1979 Berland ..... 179/107
5,226,076 A 7/1993 Baumhauer ..... 379/388
5,524,056 A * 6/1996 Killion et al. ..... 381/68.2
5,848,172 A * 12/1998 Allen et al. ..... 381/356

FOREIGN PATENT DOCUMENTS

WO WO 93 01690 1/1993
WO WO 98 30065 7/1998

* cited by examiner

*Primary Examiner*—Sinh Tran
(74) *Attorney, Agent, or Firm*—Joel Miller; Mark H. Jay

(57) ABSTRACT

A microphone of the dual-inlet type is installed in an In-The-Ear ("ITE") hearing aid. First and second outwardly-diverging channels are located in the faceplate, to connect the inlets of the microphone to two spaced-apart ports in the faceplate.

6 Claims, 3 Drawing Sheets

DIRECTIONAL ITE HEARING AID USING DUAL-INPUT MICROPHONE

BACKGROUND OF THE INVENTION

The invention relates to hearing aids, and more particularly relates to directional hearing aids. In its most immediate sense, the invention relates to directional hearing aids of the In-The-Ear ("ITE") type. (Included in the ITE type are so-called "half shell" aids, which are smaller than full size ITE aids but are larger than canal aids and Completely-In-Canal or "CIC" aids.)

Conventional hearing aids have only one omni-directional microphone, so the patient can hear sound from all directions around his or her head. This omnidirectionality impairs the patient's ability to differentiate between e.g. the voice of a conversational partner and background noise (as from a crowd). For these reasons, directional hearing aids have been developed.

As conventionally implemented in ITE aids, a directional hearing aid has two small (EM size) omnidirectional microphones that are spaced apart by at least 6 mm and by at most 12 mm. An alternate implementation of an ITE directional hearing aid uses a capsule (sold under the D-MIC mark by Etymotic Research, Inc.) that contains an EM-size dual-input directional microphone and an EM-size omnidirectional microphone together with an appropriate electronic circuit. The inlets of the directional microphone are spaced apart by 4 mm.

In both instances, the directionality of the aid comes about because there is a phase shift of the sound pressure near the inlets of the two omnidirectional microphones (and, likewise, near the two inlets of the directional microphone). Sound will reach one inlet before it reaches the other, and the resulting phase shift in combination with an internal delay of the microphone will determine the polar response of the microphone.

These two known directional ITE implementations share a significant reduction of the signal-to-noise ratio, relative to that of a conventional non-directional ITE aid. Two factors significantly contribute to this problem.

The first factor is that a directional microphone with close spacing between the inlets (of two omnidirectional microphones or of the two inlets of a dual-input microphone) has a pronounced (6 dB/octave) rolloff at low frequencies. (This rolloff comes about because lower-frequency sounds have longer wavelengths. As a result, for a particular spacing, the phase shift of the sound pressure near the inlets diminishes with decreasing frequency of the incident sound.) This rolloff reduces the sensitivity (and therefore the signal-to-noise ratio) of the aid, and requires significant electrical equalization. Such equalization amplifies the low-frequency noise, and interferes with the patient's hearing in quiet situations.

The second factor is that all other things being equal, smaller microphones generally have smaller signal-to-noise ratios. This is because a smaller microphone must have a smaller membrane, which makes the microphone less sensitive since sensitivity increases with membrane size. In quiet situations, smaller (EM-size) directional microphones can be unacceptably noisy.

To address the problem of excessive noise in quiet situations, both types of ITE hearing aids are provided with a patient-operable switch. This switch puts the aid in an omnidirectional mode when the internal noise in the directional mode becomes unacceptable to the patient. Such a switch adds to the cost of the components required to manufacture the aid, and also takes up valuable space ("real estate") on the faceplate. Because of the real estate required by the switch and the two separate microphones that must be spaced apart by at least 6 mm, certain patients e.g. those with small ears—may be unable to be fitted with directional hearing aids. Alternatively, such patients may be forced to accept larger ITE aids instead of "half shell" aids, which are less conspicuous and are therefore cosmetically preferable.

Additionally, if a directional ITE hearing aid is constructed using two omnidirectional microphones, the microphones must be well matched in respect of frequency response etc., which increases the costs of components and assembly.

It would be advantageous to provide a directional hearing aid of the ITE type where the internal noise is not substantially higher than in a conventional ITE aid. Such a directional aid would not require a patient-operable mode switch, would be less expensive to manufacture, and would use less real estate on the faceplate.

In accordance with the invention, the two small (conventionally, EM size) individual microphones that are conventionally used in an ITE aid are replaced by a bigger (advantageously, EL size) conventional dual-inlet microphone (similar, but not identical, to that presently manufactured by Knowles Electronics, Inc. as Model EL). And, in further accordance with the invention, the inlets of the microphone are connected to two spaced-apart ports in the faceplate of the aid via two outwardly diverging channels that are located in the faceplate. As a result of this structure, the ports are spaced sufficiently far apart so that the aid can be directional with maximum possible signal-to-noise ratio, without taking up valuable real estate on the faceplate of the aid.

Although dual-inlet microphones are conventionally used to make directional hearing aids of the Behind-The-Ear ("BTE" ) type, the inventor is unaware of any use of such a microphones to replace the two individual microphones previously used in ITE applications. Now that this use has taken place, it is evident that the invention produces new and unexpectedly advantageous results.

One such result is that the microphone is so quiet that a patient-operable mode-adjustment switch is not required; the aid can be maintained in the directional mode without unacceptable noise. This comes about because of the inherent characteristics of a dual-inlet EL type microphone. (These characteristics will be discussed below.) Because the switch is not required, the cost of components is reduced and valuable real estate on the faceplate is made available for other uses.

Additionally, the invention substantially reduces the costs of components and the labor required to assemble the hearing aid. The cost of a single dual-inlet microphone is substantially less than the cost of two individual microphones having matched characteristics, and it requires less labor to connect one microphone to the hearing aid electronics than to so connect two microphones (and a mode-selection switch).

Furthermore, because a dual-inlet microphone is less bulky than two individual microphones, the savings in faceplate real estate make it possible to build a directional aid in a smaller volume. As a result, more patients can be provided with a directional ITE aid, and some patients can even be provided with a "half shell" aid.

BRIEF DESCRIPTION OF THE DRAWINGS

The invention will be better understood from the following illustrative and non-limiting drawings, in which.

DETAILED DESCRIPTION OF PREFERRED EMBODIMENTS

Figure 1:
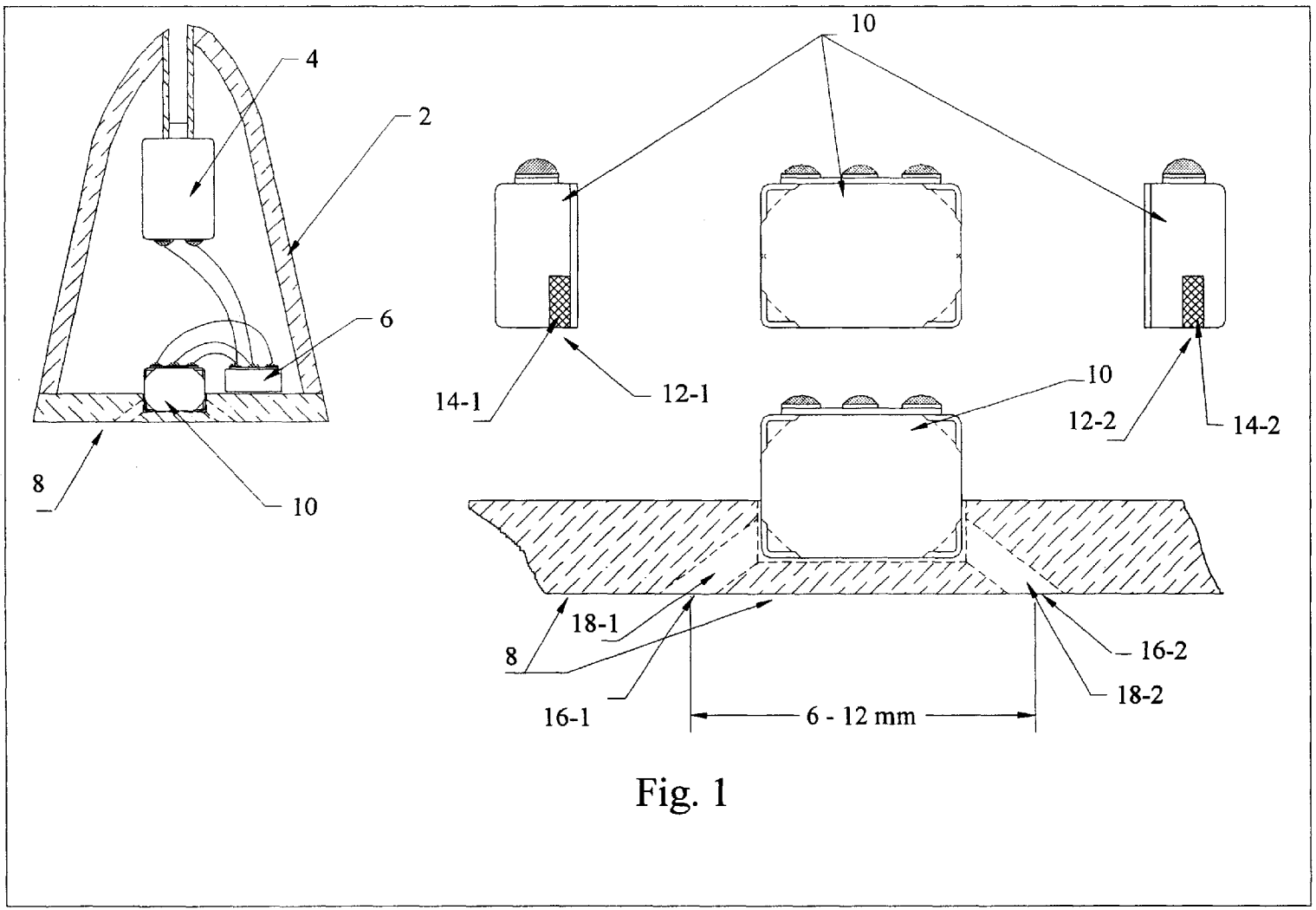
FIG. 1 schematically illustrates a first preferred embodiment of the invention.

Directional aids that use two omnidirectional microphones have a poorer signal-to-noise ratio than those that use a directional microphone of the dual-inlet type. This is because in such a dual-inlet directional microphone, both sides of the diaphragm are open to the air. The sensitivity of such a microphone is about 5 dB higher than for two omnidirectional microphones spaced the same distance apart. Another noise reduction—of about 3 dB—comes about because a two omnidirectional microphone design requires two preamplifiers, while a design utilizing a dual-inlet microphone requires only one preamplifier.

As stated above, the signal-to-noise ratio of a directional hearing aid increases with increasing spacing between the two ports of the aid. If, for example, this spacing is increased from 4 mm (as in the above-referenced D-MIC device) to 12 mm, microphone sensitivity will increase by about 8–10 dB. The aid therefore becomes much quieter.

The signal-to-noise ratio of the aid is further improved by using a single larger microphone (EL size with a larger membrane area) instead of EM size microphone with smaller membrane. Using an EL-size microphone instead of EM-size microphone increases the signal-to-noise ratio of the aid by another 3–5 dB.

The drawings are illustrative and are not necessarily to scale. The same element is always indicated by the same reference numeral in all the Figures, and corresponding elements (e.g. 8, 8' and 8") are indicated by primes.

Referring first to FIG. 1, a hearing aid housing generally indicated by reference numeral 2 is of the ITE type. The housing 2 may be of the "half shell" type.

A receiver 4 and a hearing aid circuit 6 are contained within the housing 2. A faceplate 8, having outer and inner faces 8*a* and 8*b*, respectively, seals off the exterior end of the housing 2. Attached to the faceplate 8 is a dual-inlet microphone 10. The microphone 10, the receiver 4 and the hearing aid circuit 6 are all operatively connected together.

The microphone 10 may advantageously be a modified version of a microphone now manufactured by Knowles Electronics, Inc. (Itasca, Ill.) as model number EL-3085. In the EL-3085 microphone as manufactured, spouts are attached to the side walls of the cartridge, and a wire mesh acoustic resistor is mounted inside each spout. In the microphone as modified, the spouts are removed, and mesh is attached directly to the microphone walls, covering the two holes that provide access to the opposite sides of the membrane.

As shown, each of the two inlets 12-1 and 12-2 of the microphone 10 contains an acoustic resistors 14-1, 14-2 made of e.g. wire mesh. The acoustic resistors 14-1, 14-2 provide a) a correct time delay to compensate for the time required for a sound wave to travel between the hearing aid ports and b) protection of the membrane from foreign particles.

Two ports 16-1 and 16-2 are located in the faceplate 8. The ports 16-1 and 16-2 are spaced apart by a distance that is at least 6 mm and that is at most 12 mm. Each of the ports 16-1 and 16-2 is connected to a corresponding one of the inlets 12-1, 12-2 by a corresponding one of two outwardly diverging channels 18-1, 18-2. As can be seen from FIG. 1 the channels 18-1, 18-2 are an integral part of the faceplate 8.

On test, hearing aids built with an EL-sized dual-inlet directional microphone and having an inter-port spacing of 11 mm have an Equivalent Impulse Noise (ANSI S3.22-1987) of less than 20 dB. This value is typical for non-directional ITE hearing aids.

Figure 2:
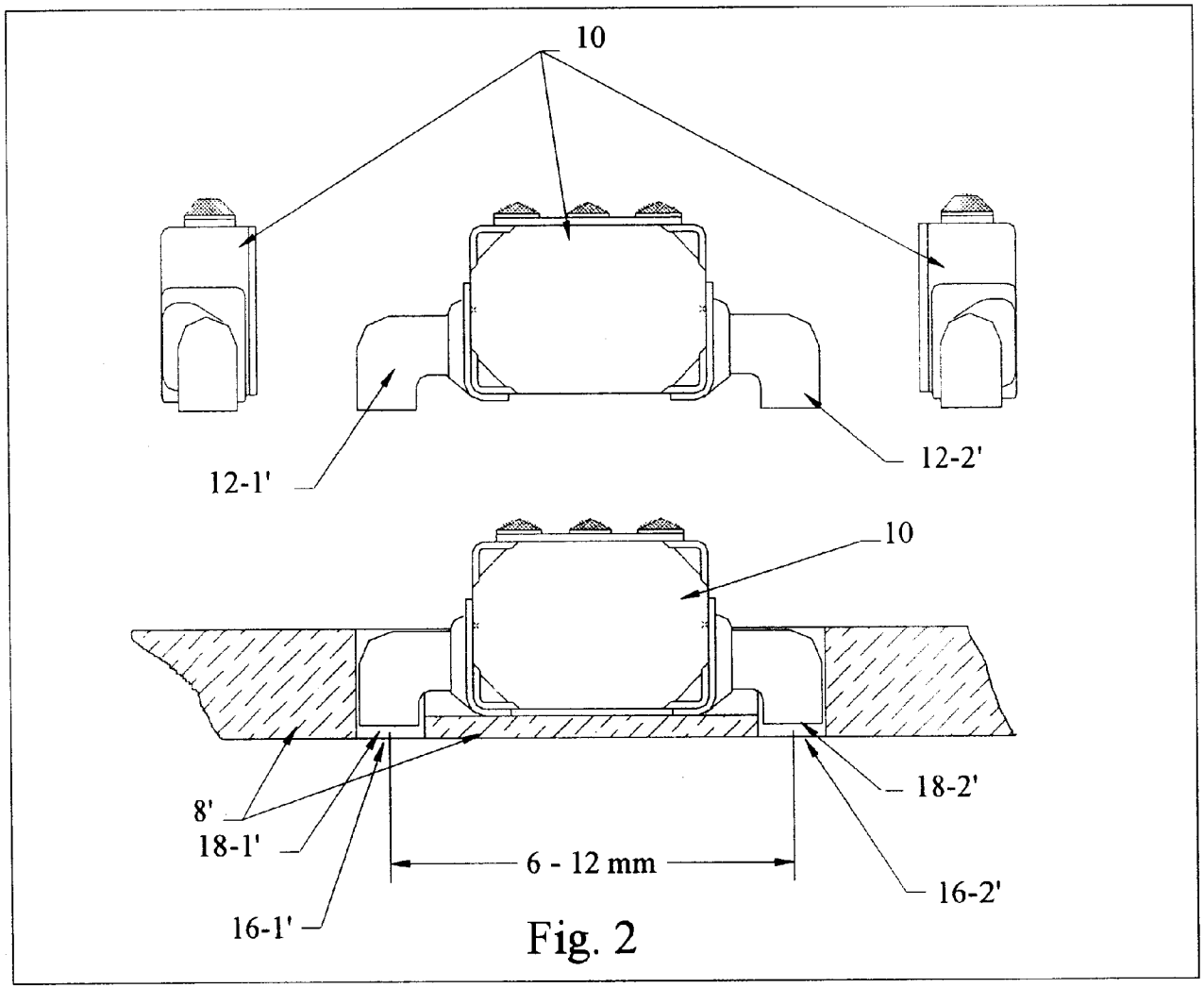
FIG. 2 schematically illustrates a second preferred embodiment of the invention.

In the embodiment shown in FIG. 2, the inlets 12-1' and 12-2' of the microphone 10' are tubular, with 90° bends. In this example, the channels 18-1' and 18-2' are shaped to mate with the shapes of the inlets 12-1' and 12-2'. The microphone 10' may advantageously be made by substituting angled spouts for the existing spouts on the above-described model EL-3085 microphone, and moving the angled spouts towards the faceplate 8'.

Figure 3:
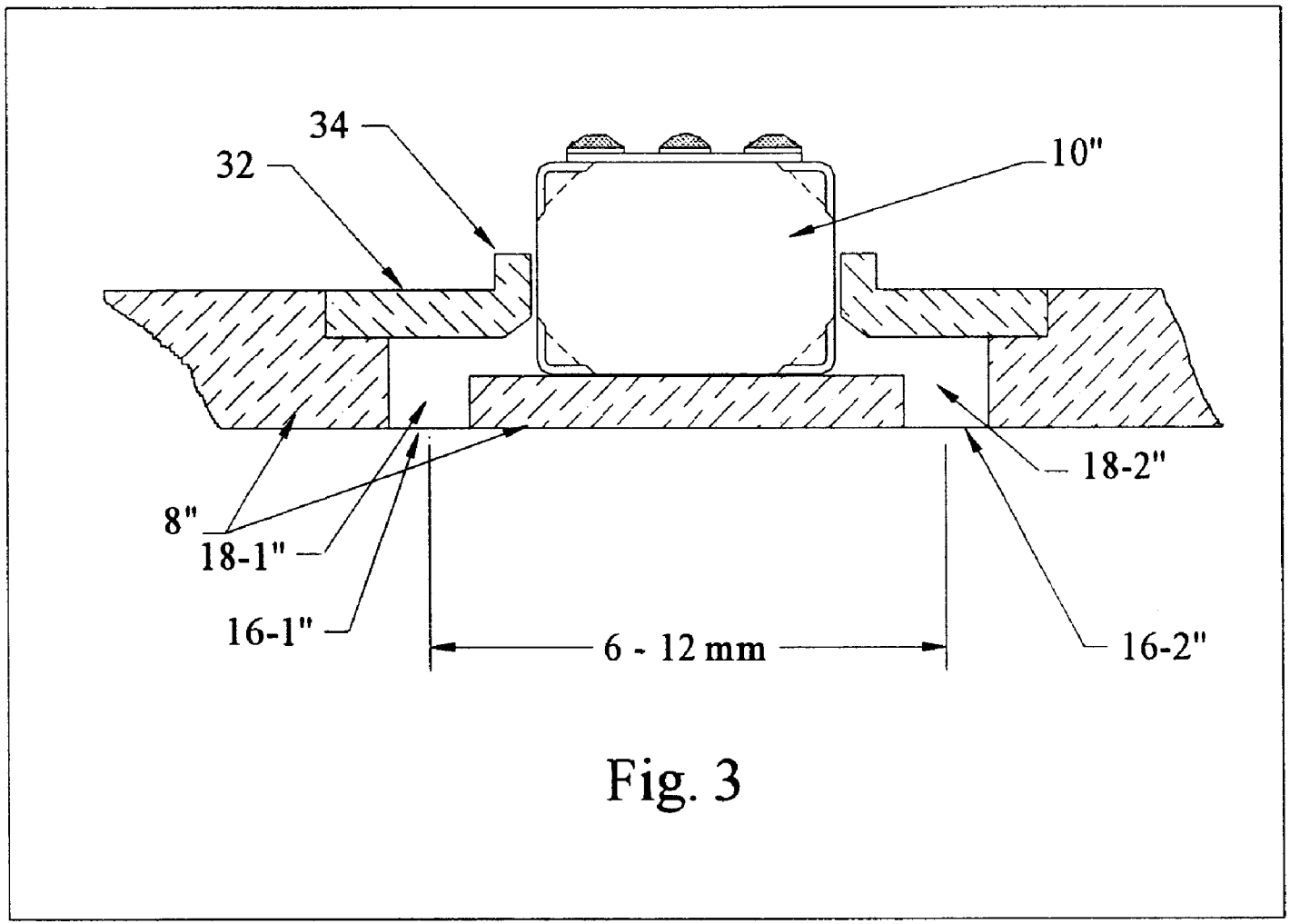
FIG. 3 schematically illustrates a third preferred embodiment of the invention.

In the embodiment shown in FIG. 3, the channels 18" and 18" are formed by spaces between the face plate 8" cavity, the microphone 10" and a rear cover 32. The microphone 10" is attached to the face plate 8" by adhesive. The rear cover 32 (which is of the same material as the face plate) is sealed by adhesive to the microphone 10" and the face plate 8".

Although one or more preferred embodiments have been described above, the scope of the invention is limited only by the following claims.

What is claimed is:

1. A directional ITE (In-The-Ear) hearing aid, comprising:

a dual-inlet microphone having first and second inlets;

a receiver;

a hearing aid circuit operatively connected to the microphone and to the receiver;

an ITE shell in which the microphone, receiver, and circuit are disposed; and a faceplate secured to the shell and enclosing the microphone, receiver, and circuit therein, the faceplate comprising outer and inner faces, where the microphone is positioned on the inner face of the faceplate; and first and second outwardly diverging channels fabricated integrally within the faceplate and running between the outer face, thereby defining ports thereon, and the inner face, each channel connecting an inlet of the microphone with one of the ports.

2. The hearing aid of claim 1, wherein the microphone has two inlet tubes, each connected to a corresponding one of the inlets, and wherein each of the inlet tubes is located in a corresponding one of the channels.

3. The hearing aid of claim 1, wherein the channels are straight.

4. The hearing aid of claim 1, wherein the ports are spaced apart.

5. The hearing aid of claim 5, wherein the ports are spaced apart approximately 6 mm to 12 mm.

6. A directional ITE (In-The-Ear) hearing aid, comprising:

a dual-inlet microphone having first and second inlets;

a receiver;

a hearing aid circuit operatively connected to the microphone and to the receiver;

an ITE shell in which the microphone, receiver, and circuit are disposed; and a faceplate secured to the shell and enclosing the microphone, receiver, and circuit therein, the faceplate comprising a front cover and a rear cover first and second ports open to the outside and spaced apart, wherein the first and second ports are located in the front cover and where the rear cover is fitted within the front cover and sealed to the microphone; and first and second outwardly diverging channels, each extending between a corresponding one of the ports and a corresponding one of the inlets, wherein the first and second channels are spaces between the front cover and the rear cover.

* * * * *